US005263792A

United States Patent [19]

Davis et al.

[11] Patent Number: 5,263,792

[45] Date of Patent: Nov. 23, 1993

[54] FINNED SUBTERRANEAN DRAINAGE DEVICE AND METHOD FOR FABRICATING THE SAME

[75] Inventors: Everett R. Davis, Harwichport; Keith R. Bartlett, Groveland, both of Mass.

[73] Assignee: W. R. Grace & Co.-Conn., New York, N.Y.

[21] Appl. No.: 966,809

[22] Filed: Oct. 26, 1992

[51] Int. Cl.[5] ..... E02B 11/00; E02D 19/00; E02D 31/00

[52] U.S. Cl. ..... 405/45; 405/36; 52/169.5; 52/792; 428/137; 428/120

[58] Field of Search ..... 405/36, 43, 45, 48; 52/169.5, 334, 480, 792; 428/119, 120, 131, 137, 178

[56] References Cited

U.S. PATENT DOCUMENTS

| | | | |
|---|---|---|---|
| 1,746,409 | 2/1930 | Sweetland et al. . | |
| 3,263,819 | 8/1966 | Schmidt et al. | 210/486 |
| 3,323,310 | 6/1967 | Arpin | 61/3 |
| 3,507,010 | 4/1970 | Doleman et al. | 18/21 |
| 3,533,896 | 10/1970 | Hartig | 428/119 X |
| 3,561,177 | 2/1971 | Agro et al. | 52/173 |
| 3,563,038 | 2/1971 | Healy et al. | 61/11 |
| 3,573,142 | 3/1971 | Chidgey et al. | 161/21 |
| 3,654,765 | 4/1972 | Healy et al. | 61/11 |
| 3,765,783 | 10/1973 | Wager | 404/2 |
| 3,965,686 | 6/1976 | Saito et al. | 61/11 |
| 4,057,500 | 11/1977 | Wager | 210/170 |
| 4,102,720 | 7/1978 | Kaneko et al. | 156/78 |
| 4,182,581 | 1/1980 | Uehara et al. | 405/43 |
| 4,425,980 | 1/1984 | Miles | 428/120 X |
| 4,563,380 | 1/1986 | Black et al. | 428/120 X |
| 4,572,700 | 2/1986 | Mantarro et al. | 404/35 |
| 4,574,541 | 3/1986 | Raidt et al. | 52/169.5 |
| 4,704,048 | 11/1987 | Ahlgrimm | 405/45 |
| 4,840,515 | 6/1989 | Freese | 405/45 |
| 4,943,185 | 7/1990 | McGuckin et al. | 405/45 |

FOREIGN PATENT DOCUMENTS

| | | | |
|---|---|---|---|
| 62-273315 | 11/1987 | Japan | 405/45 |
| 63-14921 | 1/1988 | Japan | 405/43 |
| 2028233 | 3/1980 | United Kingdom | 428/120 |
| 2056236 | 3/1983 | United Kingdom . | |

*Primary Examiner*—Randolph A. Reese
*Assistant Examiner*—Arlen L. Olsen
*Attorney, Agent, or Firm*—Craig K. Leon; William L. Baker

[57] ABSTRACT

This invention provides an improved rollable subterranean drainage core device which has T-shaped finned projections to which may be adhered a water-penetrable soil filtration fabric. The fin structure provides impact resistance and high compressive strength while providing high water channel flow-through capabilities. An exemplary method for fabricating the drainage device involves extruding a unitary finned polymeric core sheet having T-shaped projection members on at least one major side thereof, and then removing a portion of the fins in a cross direction at periodic intervals along the machine direction, so that individual T-shaped projection members are spaced in rows and columns on the rollable core sheet. The drainage core member is particularly suitable for use in conjunction with waterproofing membranes.

11 Claims, 3 Drawing Sheets

FINNED SUBTERRANEAN DRAINAGE DEVICE AND METHOD FOR FABRICATING THE SAME

FIELD OF THE INVENTION

The present invention relates to a foundation-drainage panel, and more particularly to a drainage device having a finned polymeric core structure.

BACKGROUND OF THE INVENTION

Water drainage devices are used in subsurface applications such as against foundation walls, at the edges of highways, and at the bases of civil engineering structures for removing water from subadjacent soil while "filtering" or preventing movement of soil particles therefrom. Such devices are typically rollable panels or "mats" which, when installed against a foundation wall, function to channel the water to a drainage pipe or sewer.

Drainage structures are typically fabricated using a three-dimensional core sheet having a corrugated profile with grooves therein, such as shown in U.S. Pat. No. 3,654,765 of Healy et al.; or a flat sheet having finger-like projections therefrom, such as shown in U.S. Pat. No. 4,057,500 of Wager or U.S. Pat. No. 4,572,700 of Mantarro et al.

Complex procedures for the continuous molding of core sheets are taught in U.S. Pat. No. 3,507,010 of Doleman et al. (grass-like blades) and U.S. Pat. No. 4,572,700 of Mantarro et al. (finger-like hollow cylinders) wherein revolving drum molds are used for forming the members that project outwards from the core sheet. A woven or nonwoven material, commonly called a "geotextile," is either adhered to or wrapped around the core. Thus, the core structure provides a conduit for the passage of water, while the geotextile prevents soil from entering and clogging the water conduit passages.

U.S. Pat. No. 4,840,515 of Freese and U.S. Pat. No. 4,943,185 of McGucken et al. disclose drainage units comprising a cuspated core sheet having frusto-conical projections to which are adhered a water-permeable soil filter fabric.

McGucken teaches that the drainage unit can be used in combination with a self-sealing waterproofing material which purportedly prevents water from reaching the exterior surface of the foundation wall.

The prior art drainage devices which employ hollow projections, such as the inverted frusto-conical sections taught by Freese and McGucken, are discovered by the present inventors to be incompatible when used in combination with soft waterproofing membranes or waterproofing materials. The present inventors have discovered at least two types of incompatibility between conventional drainage mats and waterproofing membranes arising sometimes after soil is backfilled against a drainage mat/waterproofing membrane that has been installed on the subterranean surface. In the first case, wherein the waterproofing membrane includes a plastic carrier sheet and adhesive layer, it is discovered by the present inventors that the carrier sheet deforms into the hollow frusto-conical projections overtime, thereby jeopardizing the integrity of the waterproofing membrane. The strain placed by soil pressures causes the sheet to deform, i.e. bulge into the backs of the cones, and to burst. In the second case, which may involve waterproofing membranes comprising soft waterproofing materials alone (e.g. rubberized asphalt, polyurethanes, etc.) or in combination with plastic carrier sheets, it is also discovered that the drainage mat exerts point-pressures which penetrate and/or displace the soft underlying waterproofing material, such that the drainage core comes into direct contact with the foundation wall or other subterranean surface. The integrity of the waterproofing material is thereby destroyed.

In view of the foregoing disadvantages of the prior art, a novel drainage device is needed.

SUMMARY OF THE INVENTION

In surmounting the disadvantages of the prior art, the present invention provides a novel subterranean drainage device which employs a novel force-distributive finned core having high flexibility and rollability, substantial anchorage area for securing thereto a water-penetrable fabric, conduit channels for high volume in-plane water flow, and compatibility when used over soft waterproofing membranes or waterproofing materials.

An exemplary drainage device comprises a flexible polymeric core sheet having a major side thereof upon which are attached a plurality of generally T-shaped fin members arranged in spaced-apart rows and columns. The fin members have generally planar-extended top members operative to provide anchorage area for securing a soil filter fabric, and body portions that are substantially perpendicular to the core sheet. In further exemplary devices, the perpendicular body portion of the fin has a tapered profile so that it is gradually thicker near the core sheet.

The present invention also provides a novel method for fabricating the drainage devices which comprises the steps of extruding a continuous polymeric core member comprising a sheet from which fins, having generally T-shaped profiles, project from at least one major face of said extruded sheet; and thereafter removing a portion of said T-shapes at intervals along the machine direction in which the continuous sheet is extruded, whereby a plurality of individual T-shaped projections are arranged in rows and columns on said sheet. The removal of T-shaped portions may be performed by cutting or grinding the T-shapes in the cross-direction at intervals along the machine direction.

DETAILED DESCRIPTION OF EXEMPLARY EMBODIMENTS

Figure 1:
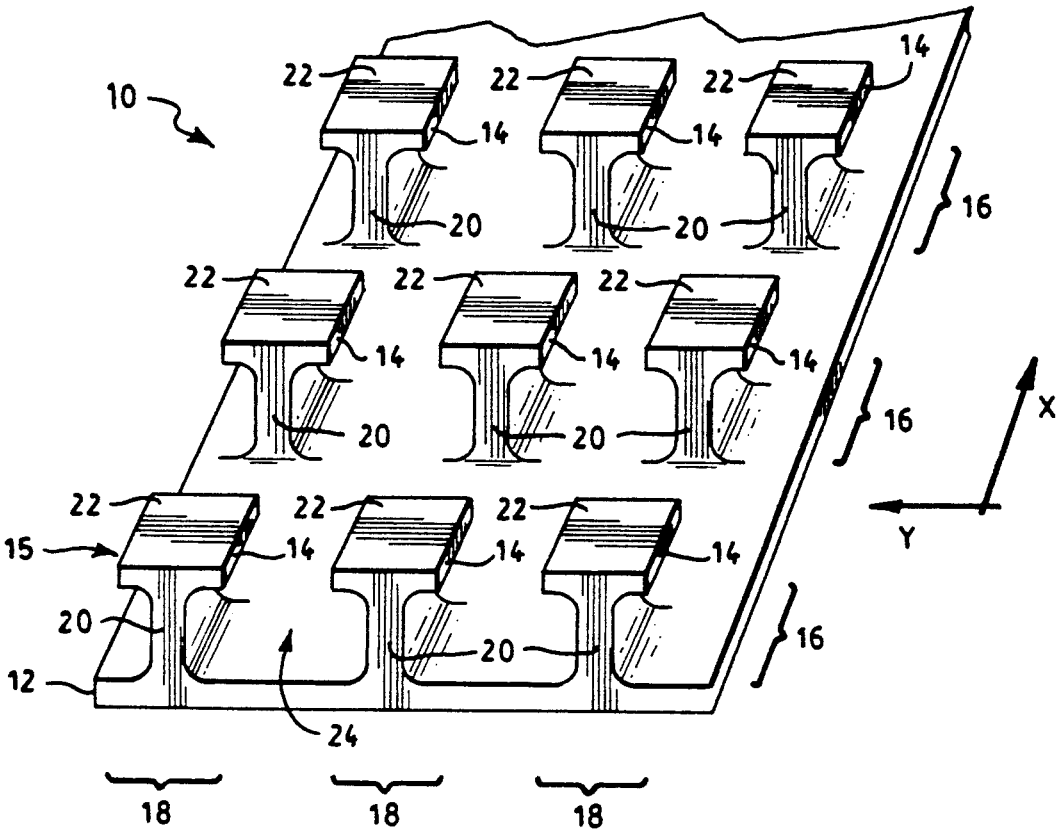
FIG. 1 is a perspective view of an exemplary finned core sheet of the invention.

In FIG. 1, there is shown a representative portion of an exemplary finned subterranean drainage core member 10 of the invention which comprises a flexible polymeric core sheet 12 disposed in a first plane, a plurality of planar-extended members 14 or generally flat fin top portions disposed in a second plane which is spaced apart from and parallel with the first plane in which the core sheet 12 is disposed.

The planar-extended fin top members 14 are arranged in rows and columns as designated generally at 16 and 18, respectively. The "X" arrow indicates the machine direction (i.e. in which the core member 10 is extruded); the "Y" arrow indicates the cross-direction which is perpendicular to the machine direction. Fin body portions 20 connect the core sheet 12 and planar-extended fin top members 14 in a substantially perpendicular fashion. The fin body portions 20 are shaped as thin walls having a much smaller cross-sectional area than the surface area of the outer surface 22 of the planar-extended fin top members 14. The outer surfaces of the fin top members 22 provide substantial area to which a geotextile, i.e., a water-penetrable fabric, can be attached. At the same time, the structure of the drainage core 10 provides an enlarged conduit water passageway 24 for increased water flow.

Thus, the appearance of the exemplary core member 10 is that of a sheet 12 having at least one major face thereof upon which are attached a plurality of generally T-shaped fin members 15. The individual, spaced-apart fin top surfaces 22 provide adequate area for adhering or heat bonding thereto a soil filter fabric without unduly blocking water flow across the plane of the fabric.

The drainage core member 10 can be fabricated from known thermoplastic materials. The materials may include polyethylene, polypropylene, polystyrene, high impact polystyrene, polyvinyl chloride, polyvinylidene chloride, polyvinyl tetrafluoride, polyvinyl acetate, polyethylene teraphthalate, polycarbonate, acrylic, polybutylene teraphthalate, polyamide, or combinations thereof.

Figure 2:
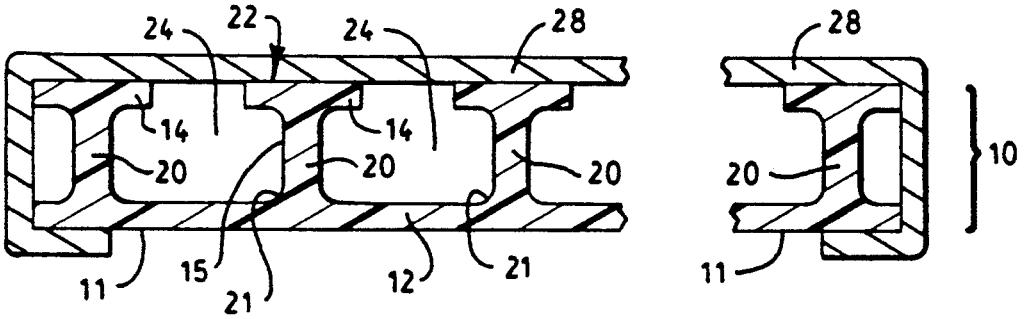
FIG. 2 is a representative view along the machine direction ("X" arrow) of the finned core sheet shown in FIG. 1 in an exemplary drainage device of the invention.

In FIG. 2, there is shown the above-described exemplary core member 10 in combination with a geotextile 28, i.e. a water-penetrable fabric, that may be glued, heat-bonded, or attached by other known means to the outer surfaces 22 of the fin top members 14. Known woven or nonwoven water-penetrable fabrics are contemplated for use in the present invention, provided that they permit the passage of water into the conduits 24 while minimizing the entry and clogging thereof by soil and sand particles. Generally, spunbonded needlepunched synthetic nonwovens made of polypropylene are preferred.

Figure 3:
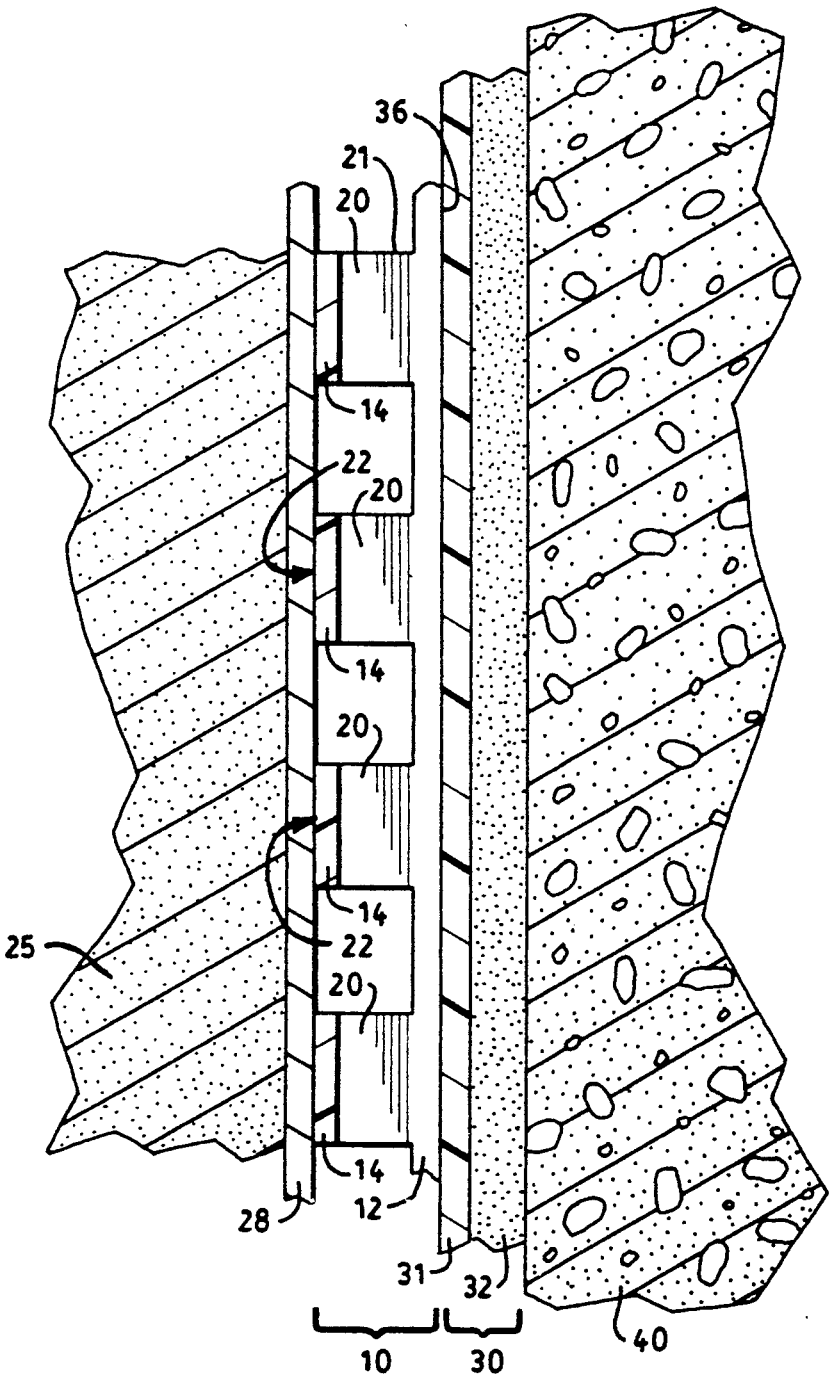
FIG. 3 is a representative view along the cross-direction ("Y" arrow) of an exemplary drainage device of the type shown in FIG. 1 in combination with an exemplary waterproofing membrane as contemplated within the invention.

In FIG. 3, there is shown an exemplary drainage/-waterproofing composite of the invention, which comprises an exemplary core member 10, a geotextile 28 operative to retain soil 25 or sand particles while permitting water penetration into the channels 24, and a waterproofing membrane 30 operative for disposition against a subterranean surface 40 such as a concrete foundation wall. The membrane 30 may comprise a pressure-sensitive adhesive such as bituminous and/or synthetic material. Preferably, the drainage core member 10 is used over a waterproofing membrane 30 comprised of a polymeric carrier sheet 31 and a rubber-modified bituminous adhesive 32. Such waterproofing membranes are available from W. R. Grace & Co.-Conn., Cambridge, Mass., under the registered tradename Bituthene®.

Preferably, the drainage core 10 should be disposed loosely or with minimal adhesion against the carrier sheet 31 so as to provide a slip plane between the drainage core 10 and waterproofing membrane laminate system 30. In other words, any downward forces exerted by settling backfilled soil 25 should be prevented from pulling or abrading the waterproofing membrane adhesive 32 from the water-penetrable surface 40 and destroying the efficacy of the membrane as a water barrier. Therefore, it is preferable to apply a weak adhesive 36 or two-sided pieces of tape at spaced-apart intervals between the drainage core 10 and waterproofing membrane carrier sheet 31. A one-inch (2.56 cm) two-sided tape comprised of a styrene-isoprene-styrene copolymer adhesive suitable for such a purpose is available from W. R. Grace & Co.-Conn., Cambridge, Mass., under the tradename BITUSTIK TM. The amount of tape used should be minimal; in other words, the minimum should be used which suffices to hold the drainage core/fabric device against the adhered waterproofing membrane until the soil can be backfilled against it.

The present invention also provides a method for fabricating the polymeric drainage core member 10, drainage device 10/28, and drainage/waterproofing composite 10/28/30 of the invention.

An exemplary fabrication method thus comprises the steps of continuously extruding the core member 10, which comprises the core sheet 12, fin body portions 20, and planar-extended fin top members 14, as a unitary piece; then removing portions of the planar-extended members 14 and finned portions 20, such as by cutting or melting those portions with a saw, drill, or heating element drawn across in the cross-direction (i.e. in the "Y" direction shown in FIG. 1) at intervals along the machine direction of the extruded drainage core member 10 (i.e. along the "X" direction shown in FIG. 1). Thereafter, a soil filter fabric 28 can be attached by using an adhesive or known thermal or chemical means to the outer surfaces 22 of the planar-extended fin top members 14.

Preferably, the fabric 28 is wrapped around the edges of the core member 10 and adhered or bonded to the back 11 of the core member 10 to prevent surrounding backfill soil from entering the water flow channels 24 (as shown in FIG. 2).

In further exemplary drainage cores of the invention, as further illustrated in FIGS. 1 and 2, the generally perpendicular fin body portions 20 have a gradually tapered thickness or profile, so that they are thickest at the points where they join the core sheet 12 and fin top planar-extended portions 14, and thinnest near the midpoint of the fin body 20. The gradual thickening, especially at the base of the fin body, helps to distribute normal forces imposed on the fins over a greater area of the flexible polymeric core sheet 12. The contoured profile of the fin body portion 20 increases both flexibility of the fin 15 and water flow capacity of the channels 24.

Therefore, when the exemplary core member 10 is used over waterproofing membranes 30, the penetration or rupture of the membrane 30 due to impact forces or underground pressures exerted against the core 10 is preferably further minimized by having a gradual thickening of the perpendicular fin body portion 20 at its base 21.

In other words, the load is distributed over a larger area and the point pressures are minimized. The strength of the fin body portion can be similarly improved by having a gradual thickening near the top fin member 14.

The term "T-shaped" as used herein shall also be understood to include "I-shaped" profiles (e.g., such as where the fin top members 22 are relatively small in comparison with the height of the fin body portions 20).

It is also possible that an exemplary core member 10 of the invention can be fabricated by attaching to a major side of a core sheet 12 a plurality of projection members having generally I-beam shaped profiles. However, for reasons of strength and integrity, it is preferable to fabricate the core member 10 as a unitary whole, such as by a continual extrusion process.

The following comparative examples are provided for illustrative purposes only and not intended to limit the scope of the invention.

EXAMPLE I

Rigid (unplasticized) polyvinyl chloride (PVC) was extruded through a die to produce a drainage core having a shape as generally illustrated in FIG. 1 but without the general rounding where the fin body portions 20 meet the core sheet 12 and fin top members 14. The core sheet 12 was approximately 0.042 inches (1.07 mm) in thickness. In the "Y" direction (see FIG. 1), the fin body portions 20 were about 0.037 inches (0.94 mm) in thickness and spaced apart in intervals of approximately 0.394 inches (10 mm). The fin body portions 20 were approximately 0.189 inches (4.8 mm) in width. In the "X" direction (machine direction), the fin body portions 20 were about 0.393 (10 mm) in length and spaced apart at intervals of approximately 0.393 inches (10 mm). From the bottom of the core sheet to the top of the fin top numbers, the height of the core was approximately 0.246 inches (6.25 mm).

The PVC core was placed over a Bituthene® 3000 brand waterproofing membrane, manufactured by W. R. Grace & Co.-Conn., which membrane was adhered on a concrete block. This membrane comprised a polyethylene carrier sheet and modified rubberized asphalt adhesive layer having a total thickness of 60 mils. The flat back of the drainage core was disposed against the carrier sheet of the membrane. A steel plate was placed against the outward facing T-shaped fin members, and a static load of 25 psi was placed on the steel plate to simulate the subterranean soil and hydrostatic pressure.

Periodically, the static load was temporarily removed and the surface of the adhered waterproofing membrane was inspected. A dead weight micrometer was used to measure any deflection induced by pressure in the waterproofing membrane in accordance with ASTM D3767. After 432 days under the 25 psi static load, the deflection of the waterproofing membrane stabilized at 5 mils; the waterproofing membrane showed no signs of damage.

EXAMPLE II

Similarly, a conventional prior art drainage core was placed over a concrete block that was waterproofed with the above-described Bituthene® 3000 brand waterproofing membrane. This drainage core was comprised of a thermoformed polystyrene sheet having hollow truncated frusto-conical "dimples" projecting from one side of the sheet. The tapered dimples were approximately 0.393 inches (10 mm) in height and had diameters of approximately 0.393 inches (10 mm) at the hollow base. The dimples were spaced apart about 0.312 inches (8 mm) from each other. A steel plate was placed against the outwardly disposed dimples, and a static load of 25 psi was placed on the steel plate. After only 20 days, the soft waterproofing membrane had deflected into the backs of the hollow dimples and the carrier sheet ruptured, causing a potential failure of the waterproofing layer.

As modifications of the foregoing exemplary embodiments may be evident to those skilled in the art, the scope of the invention is intended to be limited only by the appended claims.

We claim:

1. A subterranean drainage device comprising: a flexible polymeric core sheet having a major side thereof upon which are attached a plurality of generally T-shaped fin members arranged in spaced-apart rows and columns, said T-shaped fin members defining therebetween a conduit water passageway, wherein a continuous flow path is formed between said rows and columns, said core sheet comprising a first plane and said fin members comprising planar-extended fin top members disposed in a second plane parallel with said first plane; and fin body portions substantially perpendicular to said core sheet and connecting said fin top members to said core sheet.

2. The drainage device of claim 1 further comprising a water-penetrable fabric attached to said T-shaped fin members.

3. The drainage device of claim 2 wherein said fin body portions have increased thickness at the point at which said fin body portions are connected to said core sheet.

4. The drainage device of claim 3 wherein said core sheet is comprised of thermoplastic material.

5. The drainage device of claim 4 wherein said core sheet and generally T-shaped fin members are extruded as an integral unit.

6. The drainage device of claim 5 further comprising an adhesive disposed on said core sheet opposite the major side upon which said planar-extended members and fin portions are disposed.

7. The drainage device of claim 6 further comprising a release sheet disposed over said adhesive.

8. The drainage device of claim 6 wherein said adhesive comprises an adhesive tape disposed on the major side of said core sheet opposite the major side upon which said T-shaped fin members are disposed.

9. The drainage device of claim 4 further comprising a waterproofing membrane disposed on a major side of said core sheet opposite the major side upon which said T-shaped fin members are disposed, said waterproofing membrane comprising a pressure-sensitive bituminous or synthetic adhesive.

10. A method for fabricating a finned subterranean drainage device, comprising the steps of:

extruding a continuous polymeric core member comprising a sheet from which fins, having generally T-shaped profiles, project from at least one major face of said extruded sheet; and thereafter removing a portion of said T-shapes at intervals along the machine direction in which the continuous sheet is extruded, whereby a plurality of individual T-shaped projections are arranged in rows and columns on said sheet.

11. The method of claim 10 further comprising the step of cutting to remove portions of said T-shapes.

* * * * *